US010366824B2

(12) United States Patent
Khan

(10) Patent No.: US 10,366,824 B2
(45) Date of Patent: Jul. 30, 2019

(54) DIRECT MOUNTING BRACKET

(71) Applicant: Trench Limited, Scarborough (CA)

(72) Inventor: Kamran Khan, Ontario (CA)

(73) Assignee: TRENCH LIMITED, Ontario (CA)

( * ) Notice: Subject to any disclaimer, the term of this patent is extended or adjusted under 35 U.S.C. 154(b) by 51 days.

(21) Appl. No.: 15/484,951

(22) Filed: Apr. 11, 2017

(65) Prior Publication Data

US 2018/0294091 A1 Oct. 11, 2018

(51) Int. Cl.

| | |
|---|---|
| ***H01F 27/06*** | (2006.01) |
| ***H01F 27/32*** | (2006.01) |
| ***H01F 37/00*** | (2006.01) |
| ***H01F 27/28*** | (2006.01) |
| ***H01F 27/30*** | (2006.01) |

(52) U.S. Cl.

CPC ..... *H01F 27/324* (2013.01); *H01F 27/2876* (2013.01); *H01F 27/306* (2013.01); *H01F 37/005* (2013.01)

(58) Field of Classification Search

USPC ..... 336/65, 67, 66, 68; 248/218.4–219.4, 248/227.3

See application file for complete search history.

(56) References Cited

U.S. PATENT DOCUMENTS 3,953,815 A * 4/1976 Raupach ..... H01F 27/04 336/90
4,980,515 A * 12/1990 Sakuma ..... H01F 27/04 174/18
5,202,584 A * 4/1993 Burke ..... H01F 27/085 307/105
2011/0043320 A1* 2/2011 Reisinger ..... H01F 27/343 336/84 R
2015/0048919 A1* 2/2015 Diamanti ..... H01B 19/00 336/219
2015/0170818 A1 6/2015 Sharp et al.
2015/0176674 A1 6/2015 Khan et al.
2016/0290429 A1 10/2016 Khan et al.

FOREIGN PATENT DOCUMENTS

CN 105047361 A 11/2015

OTHER PUBLICATIONS

PCT International Search Report and Written Opinion of International Searching Authority dated Jun. 22, 2018 corresponding to PCT International Application No. PCT/US2018/026698 filed Apr. 9, 2018.

* cited by examiner

*Primary Examiner* — Elvin G Enad
*Assistant Examiner* — Kazi S Hossain

(57) ABSTRACT

An air core reactor for use in an electric power transmission and distribution system or in an electric power system of an electrical plant is provided. The air core reactor comprises an electrically insulated support structure, a coil of windings configured to operate at a potential and isolated to ground or other potentials by the electrically insulated support structure and an insulator mounting bracket that attaches directly to the coil. The insulator mounting bracket is configured as an interface between the coil and the electrically insulated support structure.

10 Claims, 2 Drawing Sheets

DIRECT MOUNTING BRACKET

BACKGROUND

1. Field

Aspects of the present invention generally relate to an interface between a coil and an insulated support structure and more specifically relate to a direct mounting bracket that attaches directly to an air core reactor coil for mounting the air core reactor coil on an insulated support structure of an air core reactor.

2. Description of the Related Art

Historically, about two generations ago, the structural requirements for substation equipment were a secondary consideration as electrical functionality trumped all. However since that time, structural robustness of substation equipment has gained importance since interruptions to service are not tolerated by customers (e.g. the ice storms in Quebec, earthquakes in California). Current design criteria now include relatively extreme conditions of fault, wind, seismic and ice/snow loads.

Moreover, the fundamentals of air core reactor construction were formulated about fifty years ago, and the construction methods reflected the structural requirements of that era. All air core reactor coils (that is the winding itself) operate at a potential and must be isolated to ground or other potentials by an electrically insulating structure. The structure can be one of many configurations, but for the purposes of brevity, only the conventional vertical column structures are discussed. This structure may include pedestals, but must always include an insulator.

A factor that greatly influences air core reactor design, and especially with regards to typical structural materials, is that the inherent magnetic field of the reactor can cause inductive heating to detrimental levels. Direct Current (DC) applications are less prone to heating, while Alternating Current (AC) applications can have extreme heating.

The vast majority of air core reactor technologies today all share a design feature from early days, a radially concentric set of metallic arms called "spiders" (in some cases these are truncated and then called "stubs"). The spiders can serve both an electrical functionality (as a conductor) and/or as a structural interface to the reactors structure. For most air core reactors, the spiders are attached to the coil (or windings) by two main methodologies—with composite bands or with bolted joints. The orientation of these spiders is specifically chosen to be in a concentric radial pattern to minimize magnetic field effects.

From a structural perspective, the ideal electrical orientation results in an element that is very weak in one axis (this is akin to balancing the reactor on a series of "knife-edges" rather than a stout support). Mechanical engineers quantify the difference in shapes to resist loads as a quantity called a moment of inertia (so a blade of a knife has a low moment of inertia while a tube has a high moment of inertia for a given cross section of material). Some manufacturers can supplement the low moment of inertia of the spider with modest gains through the use of attachments to the spiders on AC coils or off-loading the spiders through use of steel "Cradles" in DC applications (a cradle is typically a structural member with radiating arms that forms no large circulating current paths).

The size of air core reactors has historically increased and this trend in likely to continue as the market develops to ever increasing high kV solutions. Thirty years ago the largest air core reactor produced was approximately 40,000 lbs, today units have been produced in excess of 110,000 lbs. Larger coils typically result in larger structural demands. The size of today's air core reactors is such that they are among the largest equipment supported on station post insulators and thus push insulator technology to the structural limits.

The predominant material for the construction of insulator for substations (termed station post insulators) has been ceramics for the last half century. While ceramics have outstanding electrical characteristics, they have poor properties relative to most structural materials. They are weak in tension and they are brittle. Coupled to the mechanical shortcomings, there are manufacturing limitations that limit the cross-sectional area of a porcelain insulator.

In the last twenty years a new alternative has been gaining industry acceptance, i.e., composite insulators. Composite insulators are, in many ways, the opposite of porcelain insulators. They have outstanding mechanical properties and modest electrical characteristics. However if a customer accepts the electrical performance of composite technology, the structural gains are superior material strength and much greater range of possible manufacturing sizes. These later factors results in bending strengths much higher than comparable porcelain insulators. The strength of the composite insulators results in shear capabilities in excess of 30,000 lbs while conventional spider systems, even with augmentation are limited to about 10,000 lbs of shear.

There is a general need to increase the structural capabilities of electrical substation equipment coupled with increased demands from the production of larger coils. Conventional air core reactor technologies use a spider system that has a spider system of relatively modest strength. The spider acts as structural interface between the insulated support structure and the air core reactor coil. New composite insulator technology can achieve strengths greater than the strength of conventional air core reactor spider systems. While there are some design solutions (cradles) that can utilize the composite insulator strengths for DC applications, no known solutions exist for AC applications.

Therefore, there is a need for structural capabilities of electrical substation equipment to handle increased demands for the production of larger coils.

SUMMARY

Briefly described, aspects of the present invention relate to an insulator mounting bracket that attaches directly to a coil of an air core reactor to function as an interface between the coil and an electrically insulated support structure instead of using a spider. The insulator mounting bracket may be formed of three major subcomponents. The three subcomponents include a mounting flange, a body and a plurality of attachments. The benefits of the insulator mounting bracket include gain in strength, better dealing with heating and more design flexibility.

In accordance with one illustrative embodiment of the present invention, an air core reactor for use in an electric power transmission and distribution system or in an electric power system of an electrical plant is provided. The air core reactor comprises an electrically insulated support structure, a coil of windings configured to operate at a potential and isolated to ground or other potentials by the electrically insulated support structure and an insulator mounting bracket that attaches directly to the coil. The insulator mounting bracket is configured as an interface between the coil and the electrically insulated support structure.

In accordance with another illustrative embodiment of the present invention, an air core reactor for use in an electric power transmission and distribution system or in an electric power system of an electrical plant is provided. The air core reactor comprises an insulator mounting bracket that attaches directly to a coil of windings configured to operate at a potential and isolated to ground or other potentials by an electrically insulated support structure. The insulator mounting bracket is configured as an interface between the coil and the electrically insulated support structure. The insulator mounting bracket includes a mounting flange, a body and a plurality of attachments.

In accordance with another illustrative embodiment of the present invention, a method of mounting a coil of windings of an air core reactor on an electrically insulated support structure is provided. The method comprises providing an insulator mounting bracket that attaches directly to the coil of windings configured to operate at a potential and isolated to ground or other potentials by the electrically insulated support structure. The insulator mounting bracket is configured as an interface between the coil and the electrically insulated support structure. The insulator mounting bracket includes a mounting flange, a body and a plurality of attachments.

DETAILED DESCRIPTION

To facilitate an understanding of embodiments, principles, and features of the present invention, they are explained hereinafter with reference to implementation in illustrative embodiments. In particular, they are described in the context of an insulator mounting bracket or a direct mounting bracket for use with an air core reactor in place of a spider in DC and/or AC applications. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
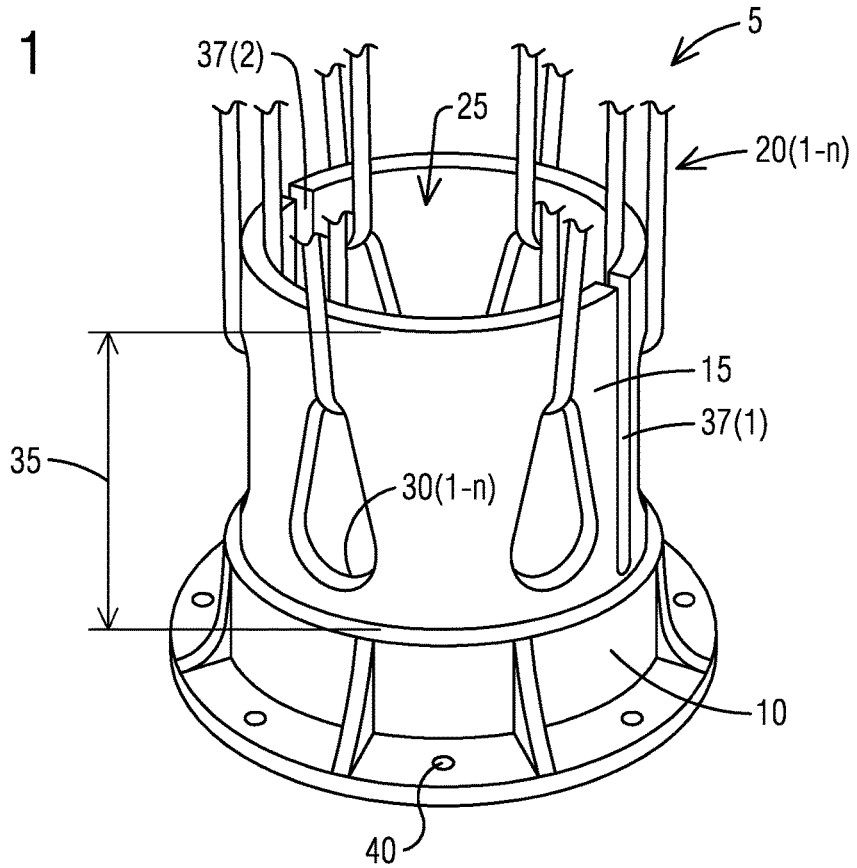
FIG. 1 illustrates a perspective view of an insulator mounting bracket in accordance with an exemplary embodiment of the present invention.
Figure 2:
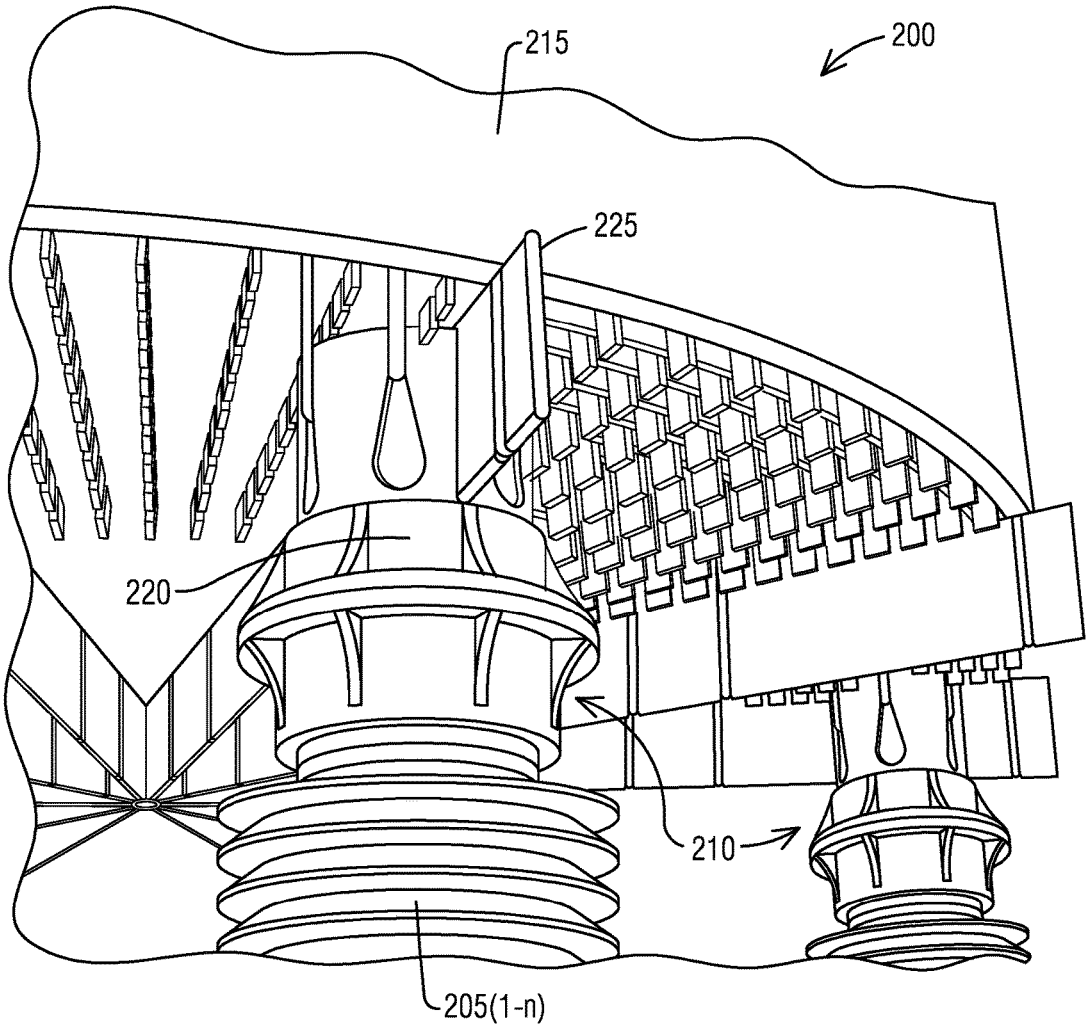
FIG. 2 illustrates a perspective view of an application of the insulator mounting bracket of FIG. 1 in an air core reactor with composite insulators in accordance with an exemplary embodiment of the present invention.

Consistent with one embodiment of the present invention, FIG. 1 represents a perspective view of an insulator mounting bracket 5 in accordance with an exemplary embodiment of the present invention. The insulator mounting bracket 5 is used with an air core reactor (as shown in FIG. 2) that is for use in an electric power transmission and distribution system or in an electric power system of an electrical plant. The insulator mounting bracket 5 is configured to attach directly to a coil (not shown) of windings configured to operate at a potential and isolated to ground or other potentials by an electrically insulated support structure (not shown). The insulator mounting bracket 5 is to be configured as an interface between the coil and the electrically insulated support structure.

In one embodiment, the insulator mounting bracket 5 includes three subcomponents. The three subcomponents include a mounting flange 10, a body 15, and a plurality of attachments 20(1-*n*). The mounting flange 10 is attached to the body 15 by: a thread between two parts, a plurality of threaded fasteners, an adhesive, a shrink or force fit or any combination of these.

The mounting flange 10 comprises any one of the materials including aluminum, austenitic stainless steel, or a non-metallic material. The body 15 comprises a non-metallic material. According to one other embodiment, the body 15 comprises a non-metallic material so as to negate heating from magnetic fields and the mounting flange 10 comprises a non-metallic material such that the body 15 and the mounting flange 10 are made as a single piece.

The body 15 comprises a closed shape in a form of an annulus 25 having a plurality of holes 30(1-*n*) for enabling convection cooling of a windings area within the closed shape. The body 15 comprises a length 35 that is dictated by magnetic field effects on an adjoining insulator and uses a bolting attachment of a circular bolt pattern 40. The body 15 comprises first and second grooves 37(1), 37(2) to receive a spider. The material for the body 15, due to its proximity to the air core reactor, would in most cases be a non-metallic so as to negate heating from the magnetic fields. The body 15 could have any form, but an annulus shape would be the preferred shape due to the structural efficiency of this shape in all directions (and the fact that most insulators use a circular bolt pattern for bolting attachment).

Attachment of the insulator mounting bracket 5 to the coil itself is via fasteners. The fasteners may be made of austenitic stainless steel or composite bolts. The plurality of attachments 20(1-*n*) may be deployed for attachment of the insulator mounting bracket 5 to the coil. An example of the plurality of attachments 20(1-*n*) is composite bands embedded into the windings of the coil during a construction process. Such composite bands may be formed as part of the body 15 or attached to attachment provisions (e.g., structures) on the body 15 (molded/machined protuberances or applied protuberances (pegs, studs, etc.)). The composite bands may be attached to attachment provisions through the cross-section of the body 15 in such cases access has to be provided to allow attachment of the composite bands during the manufacturing process.

The techniques described herein can be particularly useful for using a bracket. While particular embodiments are described in terms of a mounting bracket, the techniques described herein are not limited to the mounting bracket but can also use other structures such as a support projecting from a base or the like to hold or bear the weight of a coil.

Referring to FIG. 2, it illustrates a perspective view of an application of the insulator mounting bracket 5 of FIG. 1 in an air core reactor 200 with composite insulators 205(1-*n*) in accordance with an exemplary embodiment of the present invention. The air core reactor 200 is for use in an electric power transmission and distribution system or in an electric power system of an electrical plant.

As used herein, "an air core reactor" refers to an air core reactor for use in an electric power transmission and distribution system or in an electric power system of an electrical plant. The "air core reactor," in addition to the exemplary hardware description above, refers to a system that is configured to provide substation equipment electrical functionality. The air core reactor can include multiple interacting devices, whether located together or apart, that together perform processes as described herein.

With careful material and shape selections, it is possible to use a direct mount bracket such as the insulator mounting bracket 5 of FIG. 1 in AC applications where no adequate solution previously existed and in DC applications where the normally a cradle is used which could be dispensed with. By dispensing or minimizing the relationship with the spiders, novel configurations of support structures may be possible. Electrical losses and/or heating of spiders could be minimized through the elimination of spider elements or reduction in spider size.

The air core reactor 200 comprises an electrically insulated support structure 210 including the composite insulators 205(1-*n*). The air core reactor 200 further comprises a coil 215 of windings configured to operate at a potential and isolated to ground or other potentials by the electrically insulated support structure 210. The air core reactor 200 further comprises an insulator mounting bracket 220 that attaches directly to the coil 215. The insulator mounting bracket 220 is configured as an interface between the coil 215 and the electrically insulated support structure 210.

The primary structural benefit of the direct mounting bracket such as the insulator mounting bracket 220 is that the structural connections to the air core reactors are much more spread out than that of conventional technologies. The spread of these connections from a theoretical neutral axis increases the moment of inertia of the part approximately by the power of 2. The moment of inertia is inversely proportional to the stress (e.g. the larger the moment of inertia the lower the stress). Thus for a given material, there is a possibility to increase the capability of interface such that it fully utilizes the elevated capabilities of the composite insulators 205(1-*n*).

The insulator mounting bracket 220 is suitable for the air core reactors produced in excess of 110,000 lbs. These larger coils typically result in larger structural demands which can be handled by the insulator mounting bracket 220. The size of these air core reactors is such that they are among the largest equipment supported on station post insulators. The strength of the composite insulators 205(1-*n*) results in shear capabilities in excess of 30,000 lbs while conventional spider systems, even with augmentation are limited to about 10,000 lbs of shear.

The insulator mounting bracket 220 provides for structural capabilities of electrical substation equipment to handle increased demands for the production of larger coils. The composite insulators 205(1-*n*) may achieve strengths greater than the strength of conventional air core reactor spider systems. The insulator mounting bracket 220 may utilize the composite insulators 205(1-*n*) strengths for DC applications and AC applications.

The air core reactor 200 includes a radially concentric set of metallic arms called "spiders" 225. The spiders serve both an electrical functionality (as a conductor) and/or as a structural interface to the reactors structure. The spiders 225 are attached to the coil 215 (or windings) by two main methodologies—with composite bands or with bolted joints. The orientation of these spiders 225 is specifically chosen to be in a concentric radial pattern to minimize magnetic field effects.

Although there is no structural relationship between the insulator mounting bracket 220 and a spider, it may be beneficial to use the spider as a positioning feature for the insulator mounting bracket 220. The air core reactor 200 comprises the spider 225 that is used as a positioning feature for the insulator mounting bracket 220.

Figure 3:
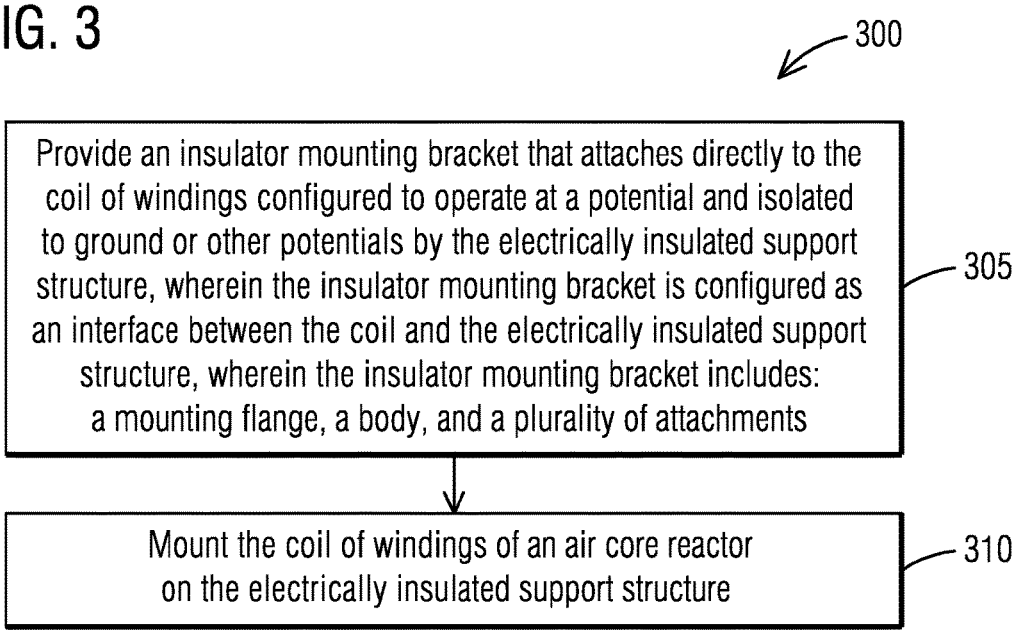
FIG. 3 illustrates a flow chart of a method of mounting a coil of windings of an air core reactor on an electrically insulated support structure according to an exemplary embodiment of the present invention.

Turning now to FIG. 3, it illustrates a flow chart of a method 300 of mounting the coil 215 of windings of the air core reactor 200 on the electrically insulated support structure 210 according to an exemplary embodiment of the present invention. Reference is made to the elements and features described in FIGS. 1-2. It should be appreciated that some steps are not required to be performed in any particular order, and that some steps are optional.

The method 300 includes, in step 305, providing the insulator mounting bracket 220 that attaches directly to the coil 215 of windings configured to operate at a potential and isolated to ground or other potentials by the electrically insulated support structure 210. The insulator mounting bracket 220 is configured as an interface between the coil 215 and the electrically insulated support structure 210. The method 300 includes, in step 310, mounting the coil 215 of windings of the air core reactor 200 on the electrically insulated support structure 210.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An air core reactor for use in an electric power transmission and distribution system or in an electric power system of an electrical plant, the air core reactor comprising:

an electrically insulated support structure;

a coil of windings supported by the electrically insulated support structure; and an insulator mounting bracket configured as an interface between the coil and the electrically insulated support structure, wherein the insulator mounting bracket includes:

a body that comprises a closed shape in a form of an annulus having a plurality of holes and the body comprises first and second grooves to receive a spider, a mounting flange attached to the body, and a plurality of attachments that are composite bands being threaded through the plurality of holes.

2. The air core reactor of claim 1, wherein the mounting flange comprises any one of the materials including aluminum, austenitic stainless steel, or a non-metallic material.

3. The air core reactor of claim 1, wherein the body comprises a non-metallic material.

4. The air core reactor of claim 1, wherein the body comprises a non-metallic material so as to negate heating from magnetic fields and the mounting flange comprises a non-metallic material such that the body and the mounting flange are made as a single piece.

5. The air core reactor of claim 1, wherein the body comprises a closed shape in a form of an annulus having a plurality of holes for enabling convection cooling of a windings area within the closed shape.

6. The air core reactor of claim 1, wherein the body comprises a bolting attachment of a circular bolt pattern.

7. The air core reactor of claim 1, wherein attachment of the insulator mounting bracket to the coil itself is via fasteners.

8. The air core reactor of claim 7, wherein the fasteners are made of austenitic stainless steel or are composite bolts.

9. The air core reactor of claim 1, wherein attachment of the insulator mounting bracket to the coil itself is via composite bands embedded into the windings of the coil during a construction process.

10. The air core reactor of claim 1, wherein a spider is used as a positioning feature for the insulator mounting bracket.

* * * * *